US008354992B2

(12) United States Patent
Rumreich et al.

(10) Patent No.: US 8,354,992 B2
(45) Date of Patent: Jan. 15, 2013

(54) APPEARANCE IMPROVEMENT FOR ZONE BACKLIT LCD DISPLAYS

(75) Inventors: Mark F. Rumreich, Indianapolis, IN (US); Brent W. Hoffman, Mooresville, IN (US)

(73) Assignee: TTE Indianapolis, Indianapolis, IN (US)

( * ) Notice: Subject to any disclaimer, the term of this patent is extended or adjusted under 35 U.S.C. 154(b) by 1557 days.

(21) Appl. No.: 11/826,318

(22) Filed: Jul. 13, 2007

(65) Prior Publication Data

US 2009/0015539 A1 Jan. 15, 2009

(51) Int. Cl.
*G09G 3/36* (2006.01)

(52) U.S. Cl. ..... 345/102; 349/64

(58) Field of Classification Search ..... 345/102; 349/61, 62, 64, 65

See application file for complete search history.

(56) References Cited

U.S. PATENT DOCUMENTS

| | | | | |
|---|---|---|---|---|
| 5,995,073 | A * | 11/1999 | Isami et al. | 345/89 |
| 6,028,690 | A * | 2/2000 | Carter et al. | 359/224.1 |
| 6,091,468 | A * | 7/2000 | Kim et al. | 349/73 |
| 6,498,631 | B2 * | 12/2002 | Natsuyama | 349/62 |
| 6,621,520 | B1 * | 9/2003 | Sawanobori | 348/341 |
| 7,355,661 | B2 * | 4/2008 | Hong | 349/65 |
| 7,826,681 | B2 * | 11/2010 | Kerofsky et al. | 382/274 |
| 7,944,429 | B2 * | 5/2011 | Kang et al. | 345/102 |
| 2002/0036608 | A1 * | 3/2002 | Hirakata et al. | 345/87 |
| 2004/0179154 | A1 * | 9/2004 | Hong | 349/113 |
| 2004/0223108 | A1 | 11/2004 | Hsieh et al. | 349/153 |
| 2007/0126757 | A1 * | 6/2007 | Itoh et al. | 345/690 |

FOREIGN PATENT DOCUMENTS

EP 0 984 314 A 3/2000

* cited by examiner

*Primary Examiner* — Joe H Cheng

(74) *Attorney, Agent, or Firm* — Morgan, Lewis & Bockius LLP

(57) ABSTRACT

A liquid crystal display device includes a display panel having an active image display region, a non-image display region surrounding the active image display region, and a border area disposed between the active image display region and the non-image display region, and a backlight device adjacent to the display panel and having a plurality of light producing elements corresponding to the active image display region, wherein the border area is disposed between the active image display region and the non-image display region to diffuse light produced by the light producing elements transmitted through the display panel within the border area.

20 Claims, 19 Drawing Sheets

APPEARANCE IMPROVEMENT FOR ZONE BACKLIT LCD DISPLAYS

BACKGROUND OF THE INVENTION

1. Field of the Invention

The present invention relates to a liquid crystal display (LCD) device. More specifically, the present invention relates to an appearance improvement for zone backlit LCD devices and a method of reducing power consumption of an LCD device.

2. Discussion of the Related Art

In general, LCD devices are illuminated using various backlight devices. For example, light emitting diodes (LEDs) and fluorescent lamps (FLs), such as cold cathode fluorescent lamps (CCFLs) and hot cathode fluorescent lamps (HCFLs), are commonly used to provide light that passes through transparent substrates of the LCD devices. However, the backlight devices require significant amounts of power to produce the light for displaying images of a display panel of the LCD devices. Accordingly, a method of zone backlighting has been developed as a useful way for reducing power consumption in LCD devices. Using the zone backlighting method, power is reduced by shrinking the active image display region of the display panel. Thus, only the active image display region of the display panel requires illumination.

Using the zone backlighting method has many undesirable side effects including the creation of a halo border effect due to the low contrast ratio of the display panel. Specifically, when an image is produced on the display panel, elements of the backlight device outside of the active image display region are illuminated to ensure that the perimeter portions of the active image display region are of the same image intensity as a central portion of the active image display region. As a result, regions outside of the perimeter portions of the active image display region are illuminated and perceptually recognized to the eye of the viewer. Thus, since LCD pixels just outside of the active image display region may pass light due to light leakage, a halo border is generated along the perimeter of the active image display region distracting the viewer from the displayed images.

FIG. 1 is a reproduction of a display panel of an LCD device having a halo border effect for an LED zone backlighting according to the prior art, and FIG. 2 is a schematic plan view of an LED backlight device according to the prior art. In FIG. 1, the display panel 100 includes an active image display region 110 and a surrounding non-image display region 120. Accordingly, since the perimeter portions of the active image display region 110 must have same image intensity as the central portion of the active image display region 110, the LED elements of the backlight device outside of the active image display region 110 are illuminated. In FIG. 2, the LED elements 200*a* that would correspond to the perimeter portions of the active image display region 110 and the LED elements 200*b* that would correspond to the central portion of the active image display region 110 are powered to provide the same illumination intensity. Thus, as shown in FIG. 1, a halo border 130 is produced along the perimeter portions of the active image display region 110. As a result, image contrast is significantly reduced along the perimeter portions of the active image display region 110 due to the presence of the halo border 130. This reduced image contrast causes strain to a viewer's eye, thereby rendering the displayed images unpleasant to watch.

FIG. 3 is a reproduction of a display panel of an LCD device having a halo border effect for a fluorescent lamp FL (i.e, CCFLs or HCFLs) zone backlighting according to the prior art, and FIG. 4 is a schematic plan view of a FL (i.e., CCFLs or HCFLs) backlight device according to the prior art. In FIG. 3, the display panel 300 includes an active image display region 310 and a surrounding non-image display region 320. Accordingly, since the perimeter portions of the active image display region 310 must have same image intensity as the central portion of the active image display region 310, the FL elements of the backlight device outside of the active image display region 310 are illuminated. In FIG. 4, the FL backlight device 400 includes FL elements 410 that extend along an entire length L of the display panel 300 (in FIG. 3). Each of the FL elements 410 have end regions 420*a* that together with the outermost FL elements 410*a* would correspond to the perimeter portions of the active image display region 310 (in FIG. 3). In addition, the central regions 420*b* and the FL elements 410*b* would correspond to the central portion of the active image display region 310 (in FIG. 3). Accordingly, each of the FL elements 410 are powered to provide the same illumination intensity across the entire length L of the display panel 300 and within the active image display region 310 (in FIG. 3).

As shown in FIG. 3, since the FL elements 410 (in FIG. 4) extend along the entire length L of the display panel 300 outside the active image display region 310, a halo border 330 is produced along the entire length L of the display panel 300 and along a width W of the perimeter portions of the active image display region 310. As a result, image contrast is significantly reduced along the perimeter portions of the active image display region 310 due to the presence of the halo border 330. Moreover, the halo border 330 extends along the entire length of the display panel 300, thereby rendering images produced in the active image display region 310 unpleasant to view.

In addition, each of the LCD devices of FIGS. 1 and 2 unnecessarily consume a large amount of power to illuminate non-display regions of the display panels. Accordingly, a method is needed that significantly reduces the production of the halo border effect and reduces the unnecessary consumption of power to illuminate the non-image display region.

SUMMARY OF THE INVENTION

Accordingly, the present invention is directed to an LCD device and a method of producing images on a display panel of an LCD device that substantially obviates one or more of the problems due to limitations and disadvantages of the related art.

An object of the present invention is to provide an LCD device that significantly reduces the appearance of the halo border effect.

Another object of the present invention is to provide an LCD device that reduces power consumption.

Another object of the present invention is to provide a method of reducing power consumption of an LCD device.

Additional features and advantages of the invention will be set forth in the description which follows and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a liquid crystal display device includes a display panel having an active image display region, a non-image display region surrounding the active image display region, and a border area disposed between the active image display region and the non-image display region, and a backlight device adjacent to the display panel and having a plurality of light producing elements corresponding to the active image display region, wherein the border area is disposed between the active image display region and the non-image display region to diffuse light produced by the light producing elements transmitted through the display panel within the border area.

In another aspect, a liquid crystal display device includes a display panel having an active image display region and a non-image display region surrounding the active image display region, and a backlight device adjacent to the display panel and having a plurality of light producing elements corresponding to the active image display region, wherein the plurality of light producing elements include a first group of light producing elements producing light and disposed within a central area of the active image display region operating at a first power input level, and a second group of light producing elements producing light and disposed along a perimeter of the active image display region and operating at a second power input level lower than the first power input level.

In another aspect, a method of reducing power consumption of a liquid crystal display device includes providing a first plurality of light producing elements of a backlight device disposed adjacent to a display panel of the liquid crystal display device, each of the first plurality of light producing elements receiving a first input power level and producing a first amount of light, the first plurality of light producing elements disposed adjacent to a central area of an active image display region of the display panel, and providing a second plurality of light producing elements of the backlight device disposed adjacent to the display panel of the liquid crystal display device, each of the second plurality of light producing elements receiving a second input power level less than the first input power level and producing a second amount of light, the second plurality of light producing elements disposed adjacent to a perimeter area of the active image display region of the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principles of the invention. In the drawings.

DETAILED DESCRIPTION OF THE PREFERRED EMBODIMENTS

Reference will now be made in detail to the illustrated embodiments of the present invention, examples of which are illustrated in the accompanying drawings.

Figure 1:
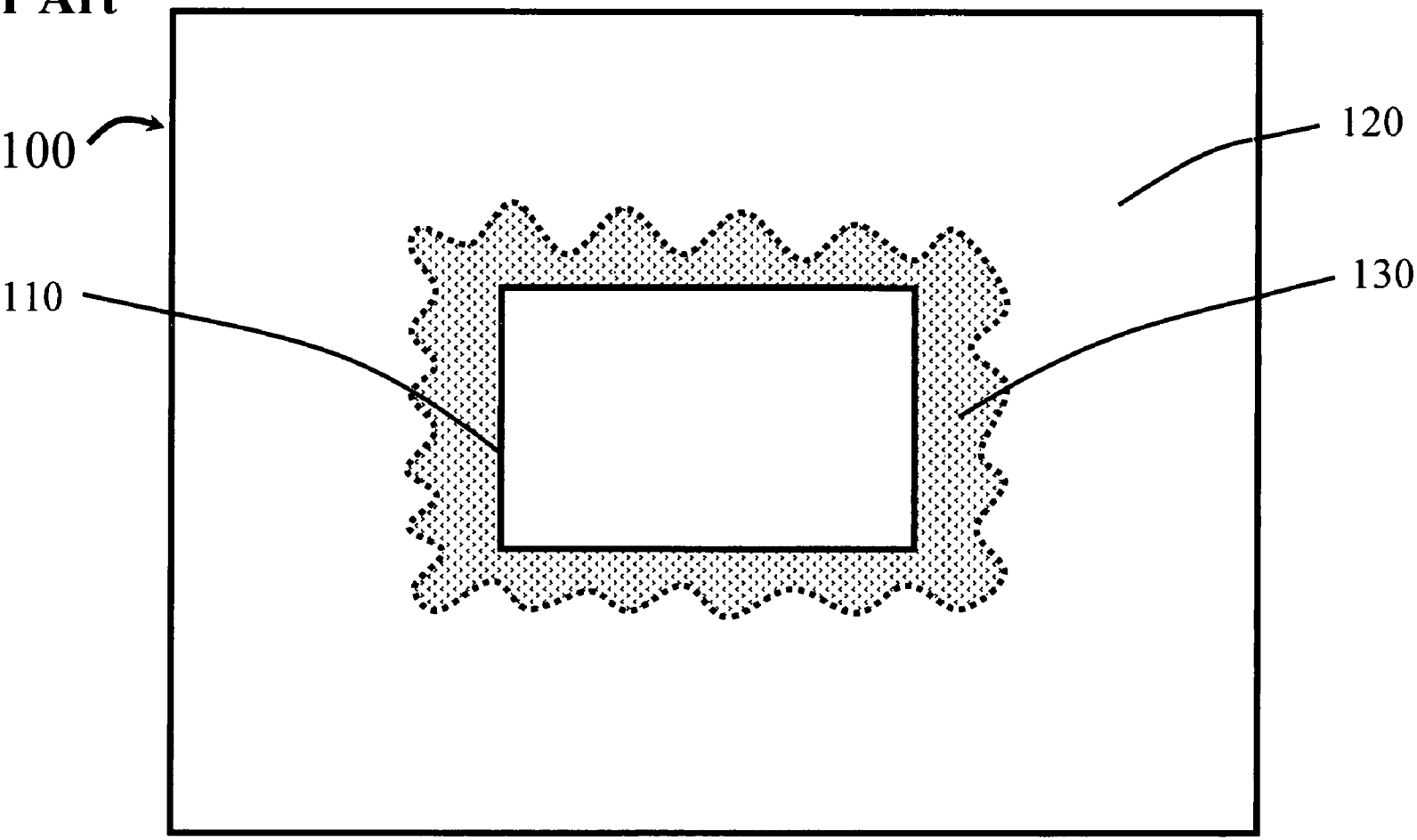
FIG. 1 Prior Art
FIG. 1 is a schematic view of a display panel of an LCD device having a halo border effect for an LED zone backlighting according to the prior art.
Figure 2:
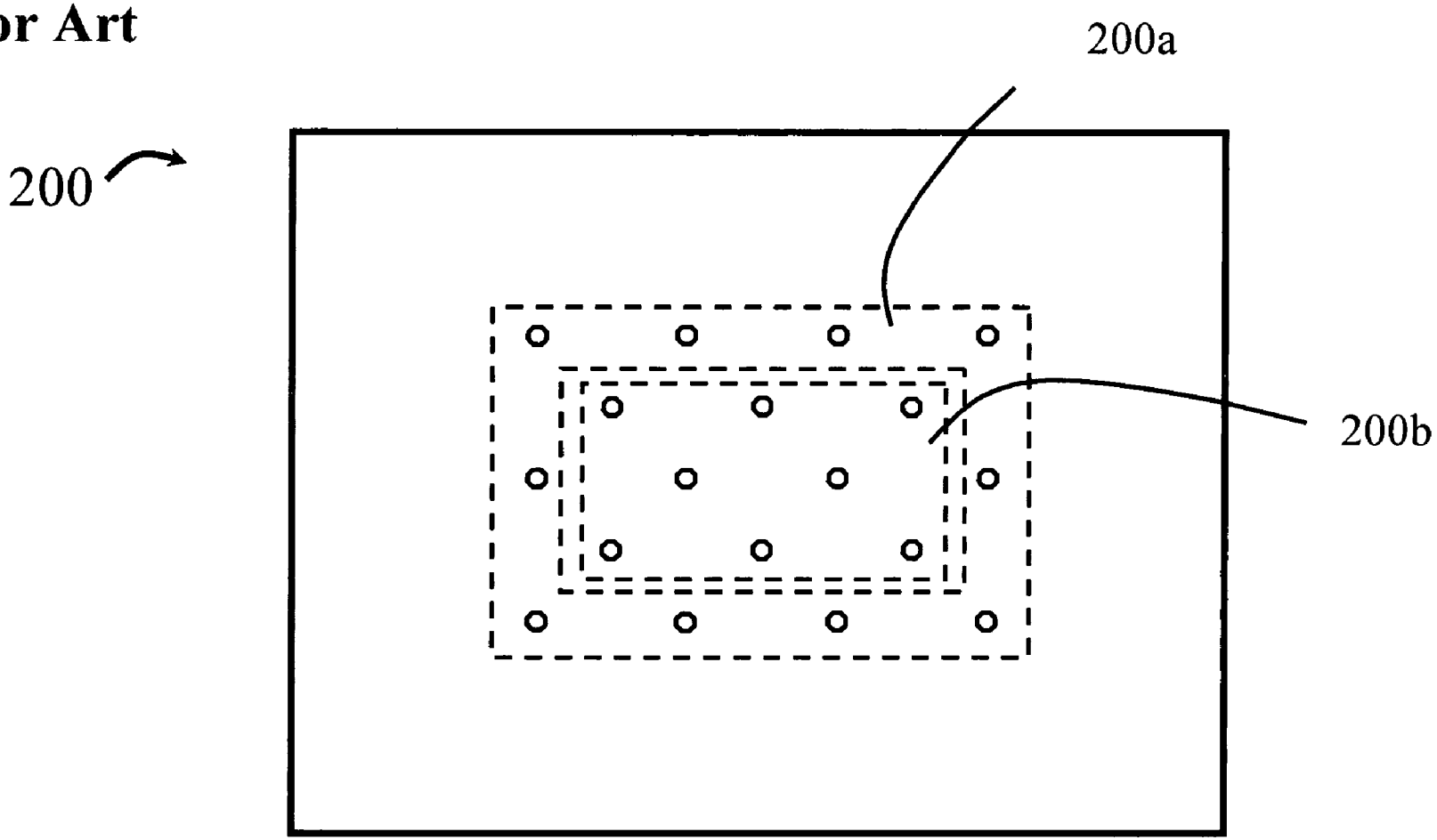
FIG. 2 Prior Art
FIG. 2 is a schematic plan view of an LED backlight device according to the prior art.
Figure 3:
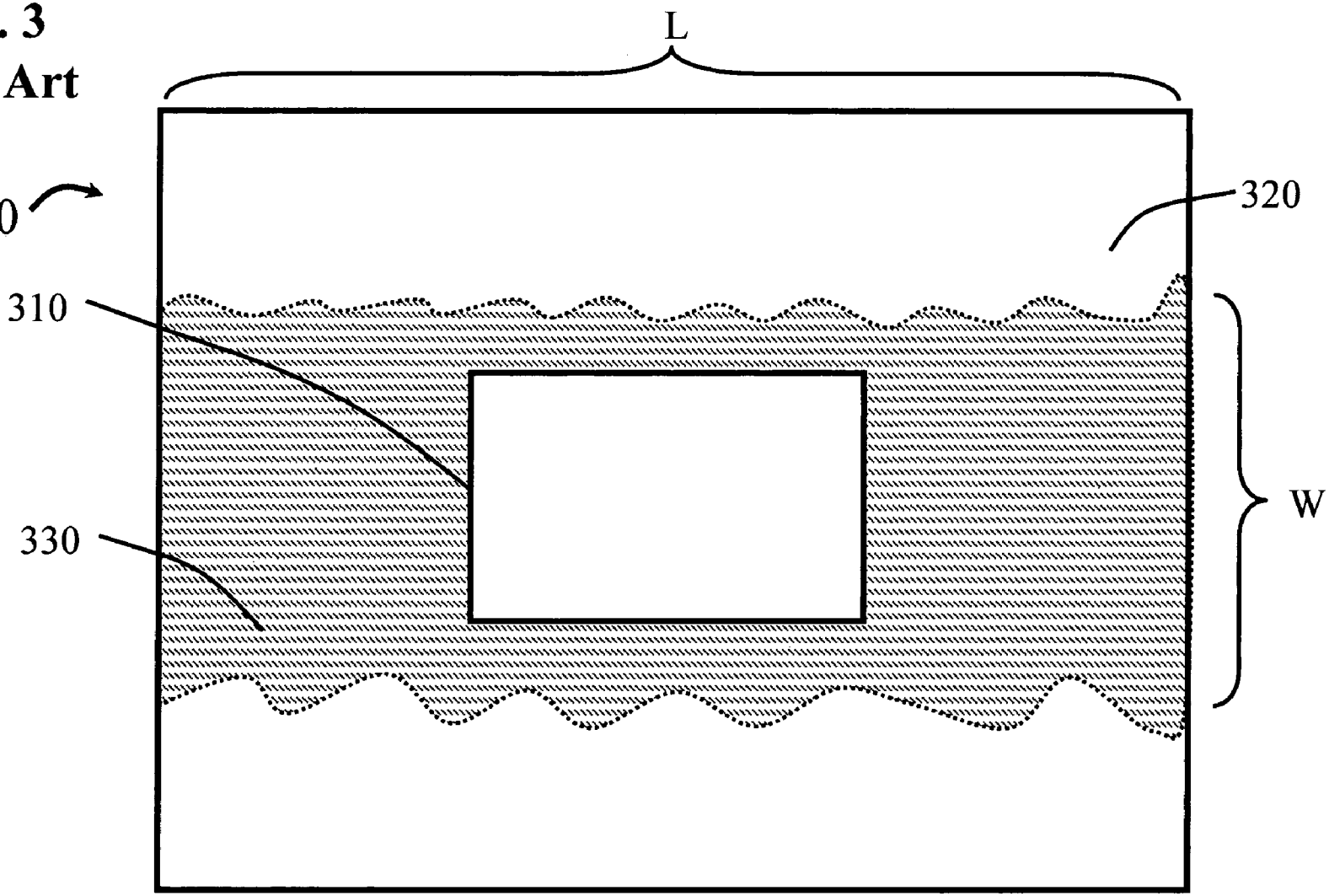
FIG. 3 Prior Art
FIG. 3 is a schematic view of a display panel of an LCD device having a halo border r a fluorescent lamp FL zone backlighting according to the prior art.
Figure 4:
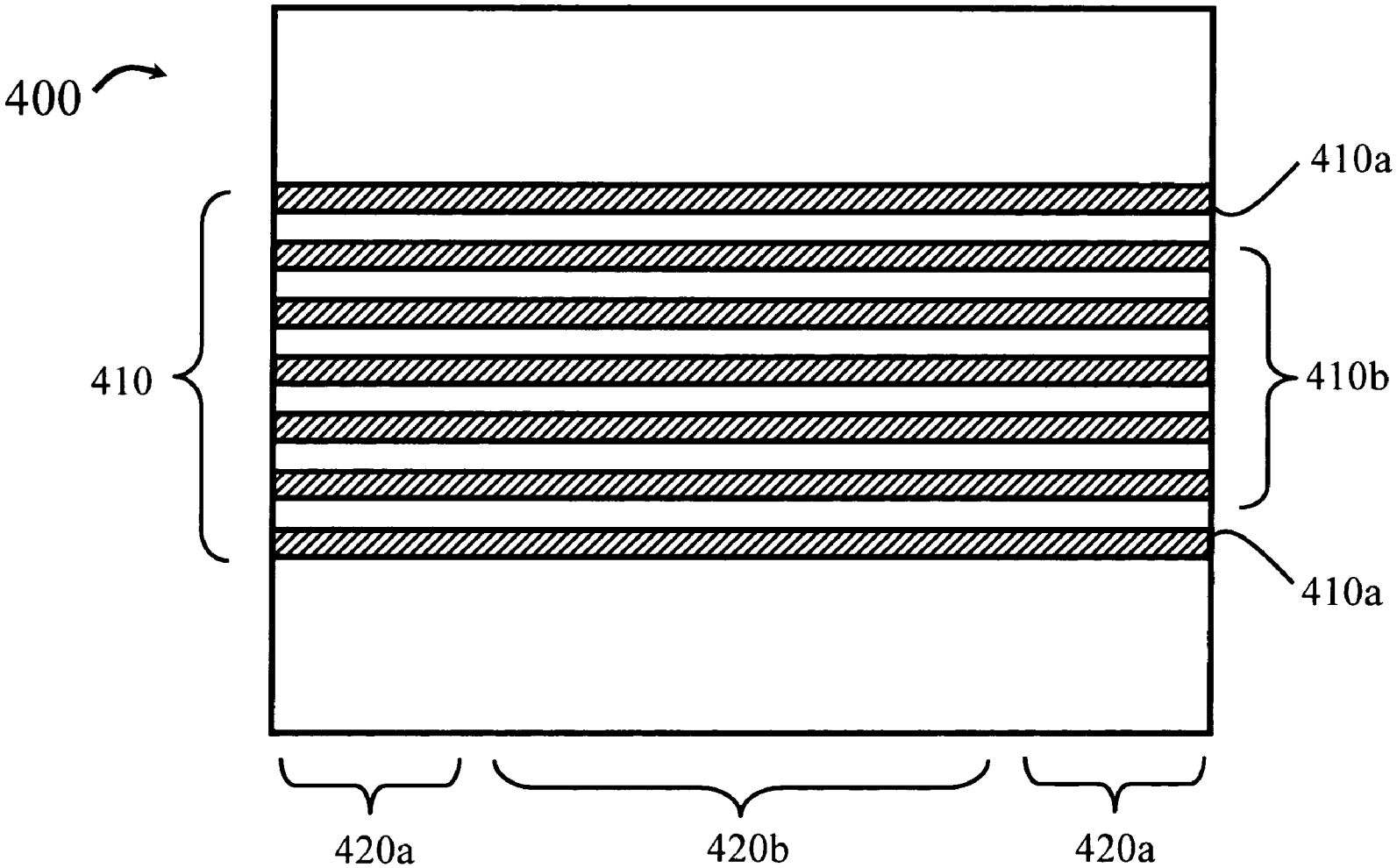
FIG. 4 Prior Art
FIG. 4 is a schematic plan view of a FL backlight device according to the prior art.
Figure 5A:
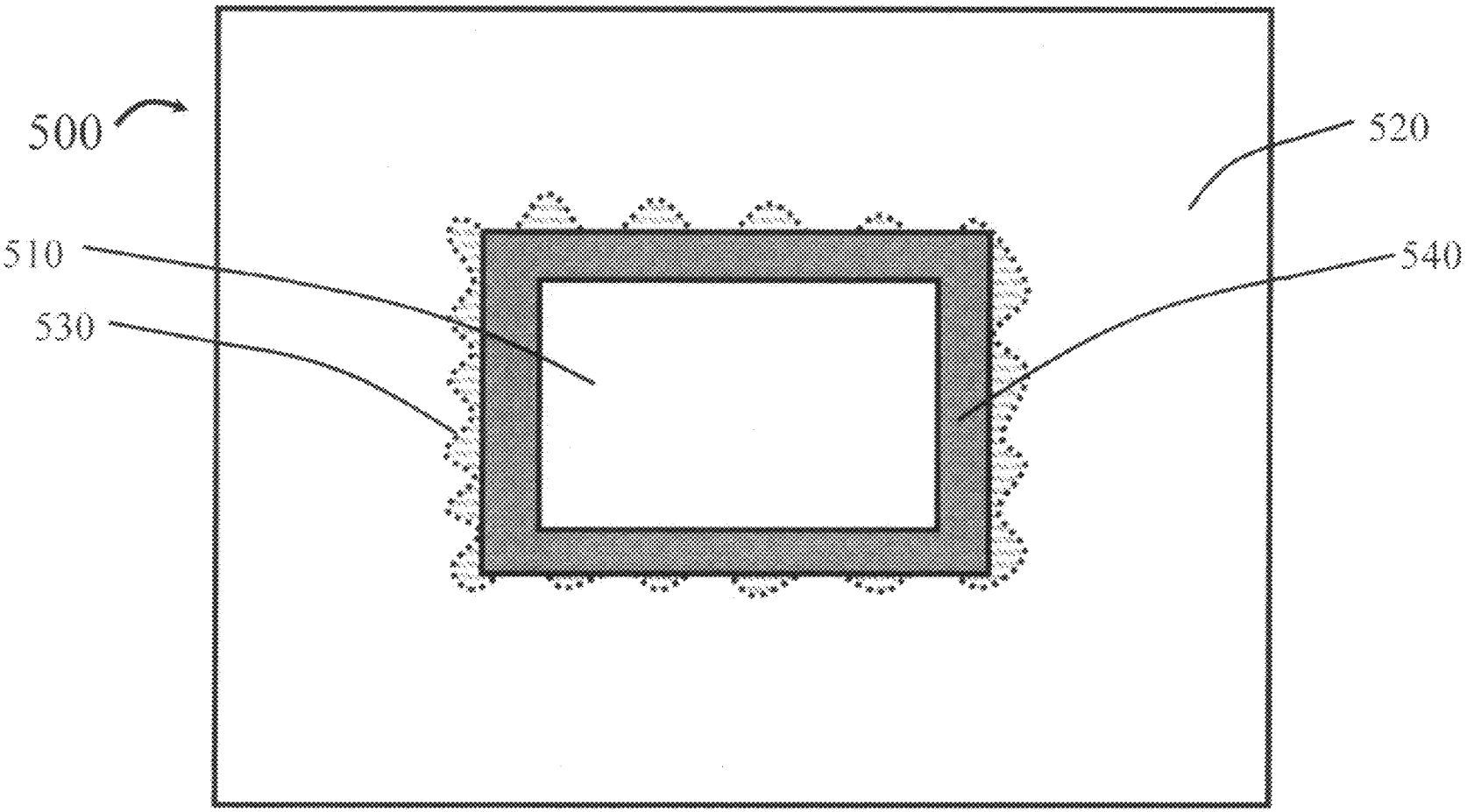
FIGS. 5A-H are schematic views of exemplary display panels of an LCD device having backlight device using a bordering technique according to the present invention.

FIGS. 5A-H are schematic views of exemplary display panels of an LCD device having an LED backlight device using a bordering technique according to the present invention. In FIG. 5A, a display panel 500 includes an active image display region 510, a non-image display region 520 that surrounds the active image display region 510, and a border area 540 disposed between the active image display region 510 and the non-image display region 520. Although not specifically shown, a backlight device having a matrix array of LEDs may be disposed on a backside of the display panel 500 to provide light that passes through the display panel 500 to display images.

Although a halo region 530 may exist along an outermost perimeter of the border area 540 in the display panel 500, a viewer may not be distracted from viewing images produced in the active image display region 510 due to the presence of the border area 540. The border area 540 may perceptually "fool" a viewer's eye by providing for a gradual transition region from the relatively brighter images displayed by the display panel 500 to the less bright regions of the halo region 530 and the non-image display region 520.

Illumination intensity within the border area 540 may be selected at a higher level of non-uniformity than may be acceptable within the active image display region 510. Accordingly, the transition region is created by the border area 540 between the active image display region 510 and the halo region 530 to diffuse the light produced by the backlight device (not shown).

The border area 540 may be produced by modifying the pixel values of the pixel regions disposed adjacent to the active image display region 510. Accordingly, modification of the pixel values may not result in modifying operational characteristics of the backlight unit (not shown). Thus, no additional power is required to operate the backlight unit (not shown).

Figure 5B:
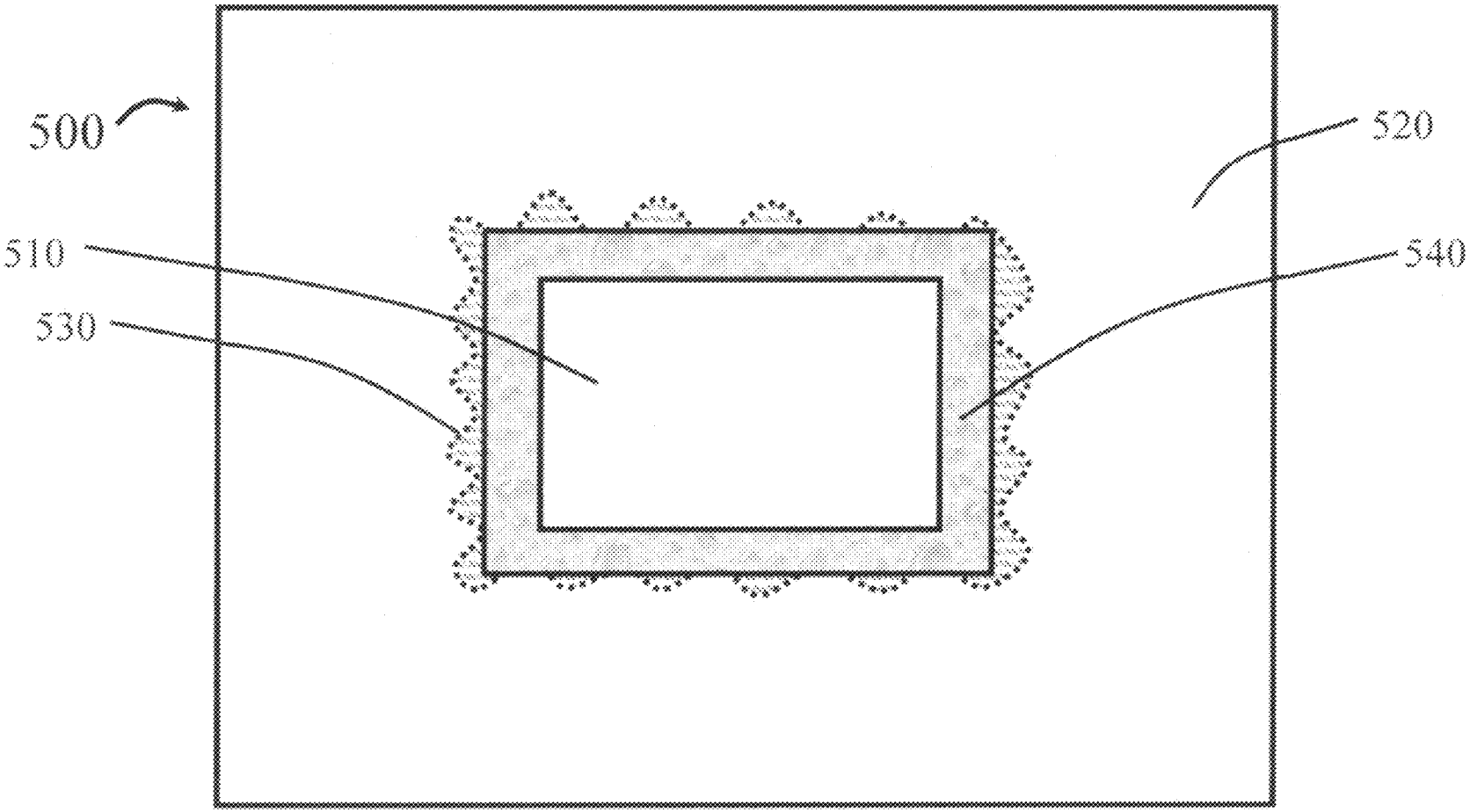
Figure 5C:
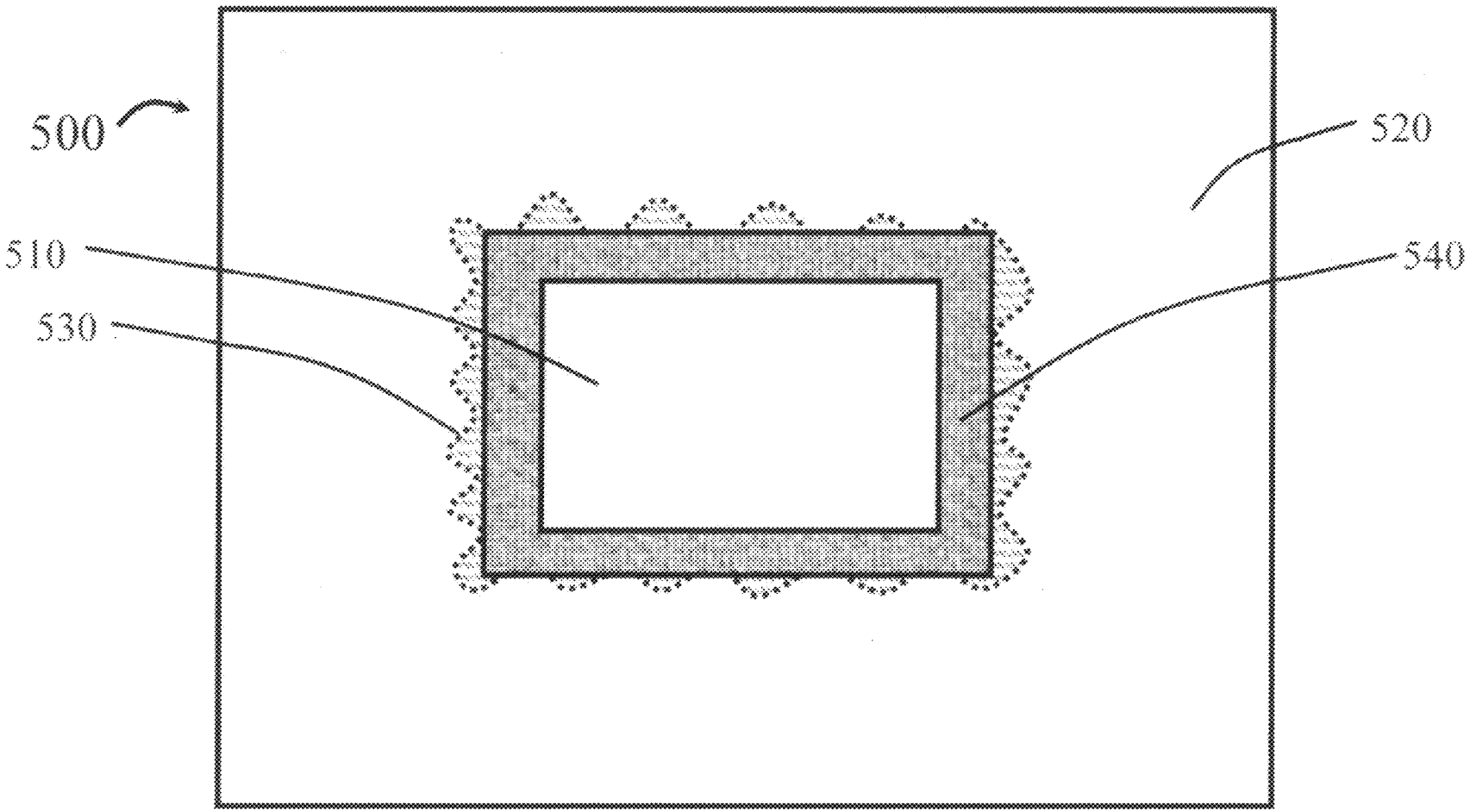
Figure 5D:
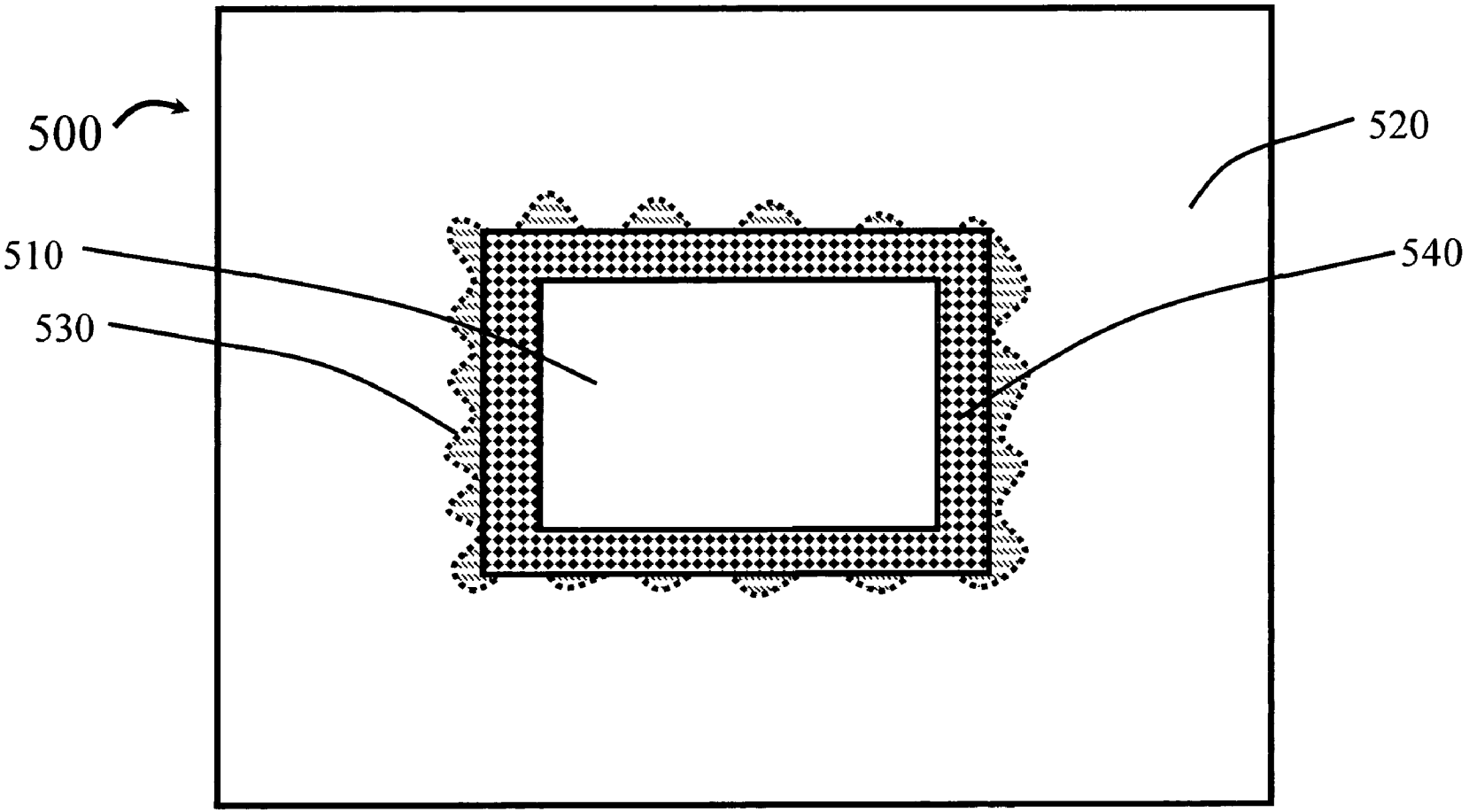
Figure 5E:
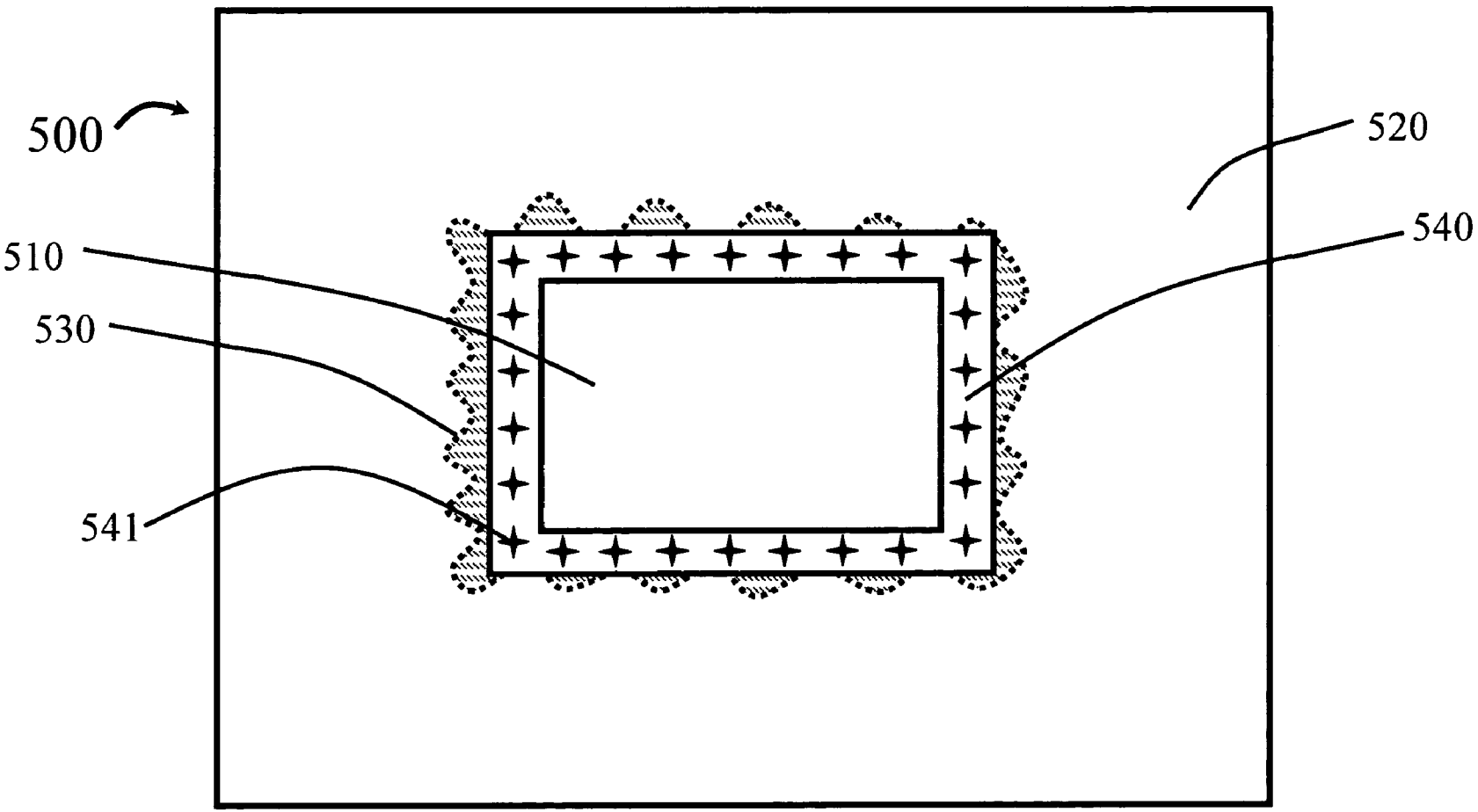
Figure 5F:
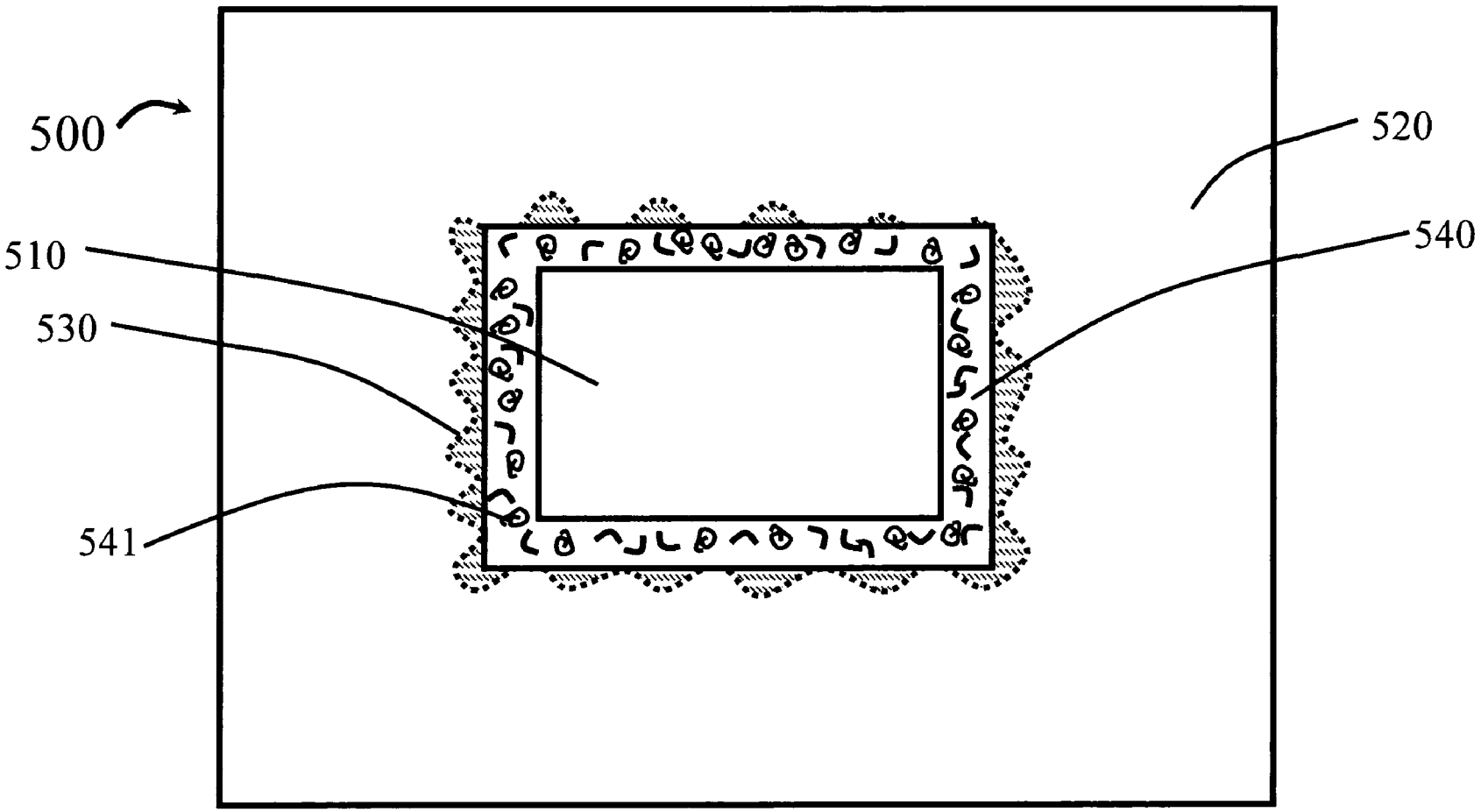
Figure 5G:
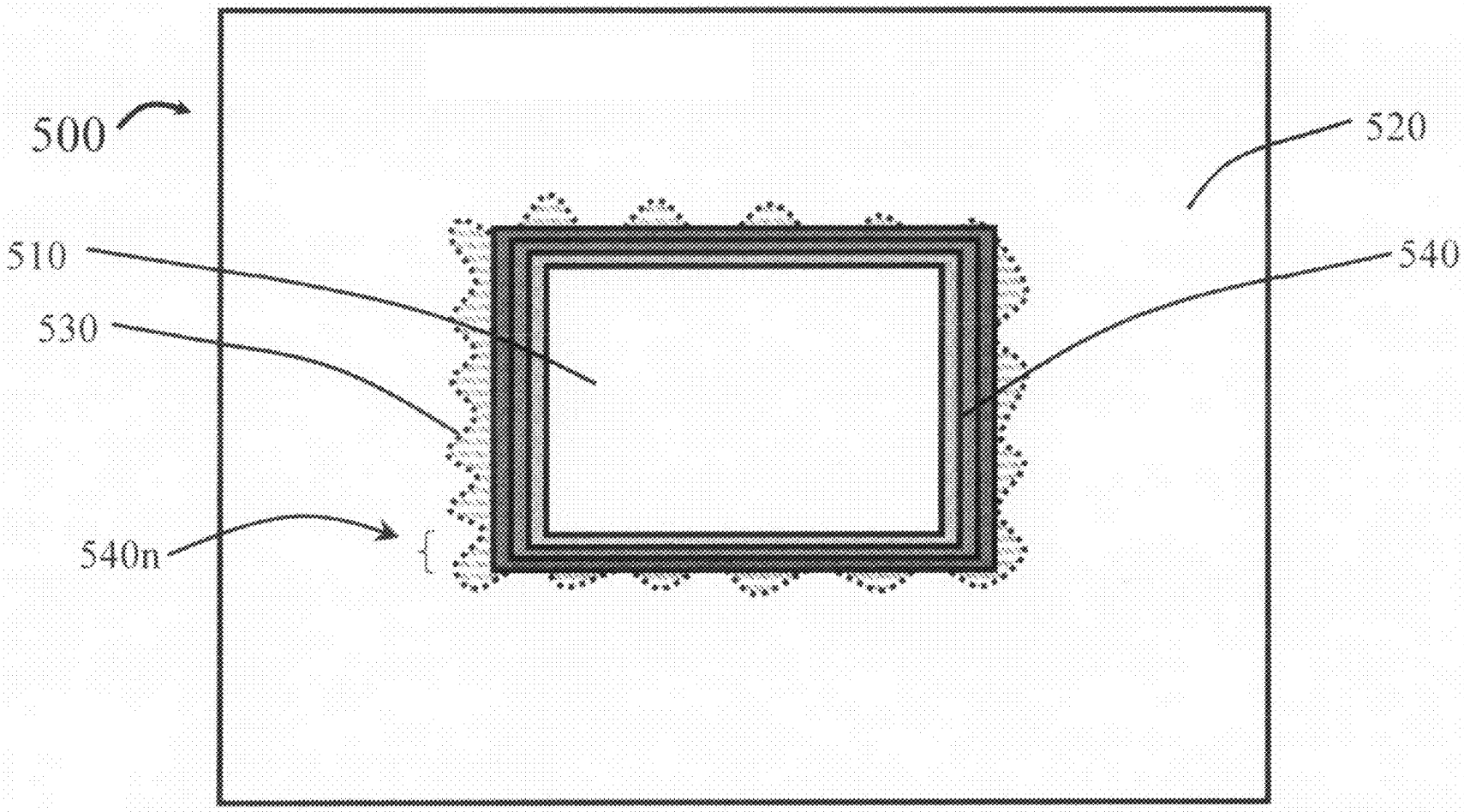
Figure 5H:
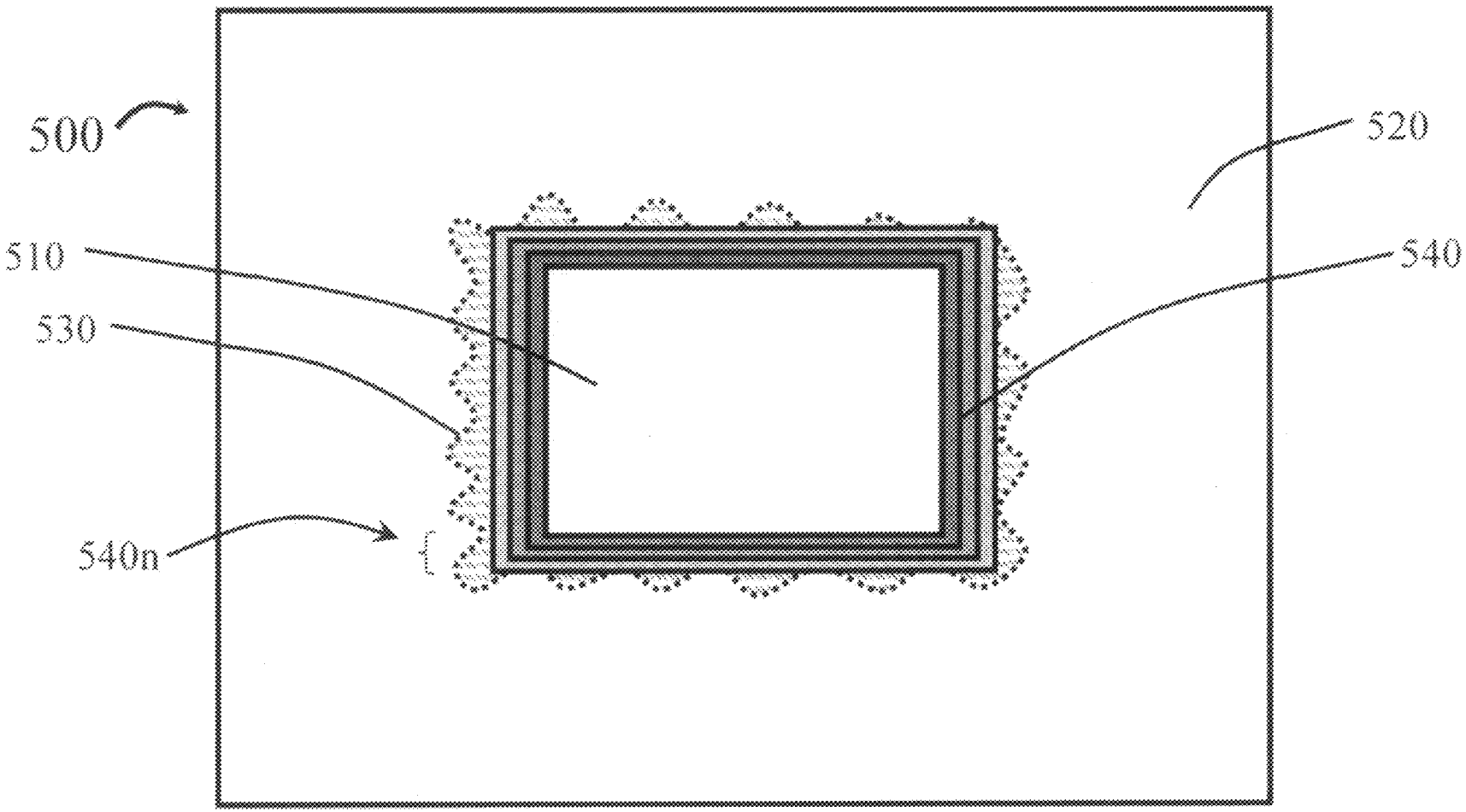

In FIG. 5A, although the border area 540 is shown as having a solid gray-scale rectangular geometry, other geometries and colors may also be implemented. For example, as shown in FIGS. 5B and 5C, the border area 540 may include different patterned textures, such as images of water-droplets and woven fabrics. As shown in FIGS. 5D and 5E, the border area 540 may include a plurality of ordered patterned elements 541. As shown in FIG. 5F, the border area 540 may include a plurality of randomly positioned patterned elements 541. As shown in FIGS. 5G and 5H, the border area 540 may include a plurality of inner frames 540*n* having gradual shading (i.e., gradiently shaded) from lighter to darker and from darker to lighter.

Moreover, the border area 540 may be manually altered by a user or alterations may be synchronized with the images displayed in the active image display region 510. Furthermore, the border area 540 may partially counteract any non-uniform illumination within the border area 540 itself. For example, the border area 540 may have increased dark pixel values in areas where the illumination is higher.

Figure 6:
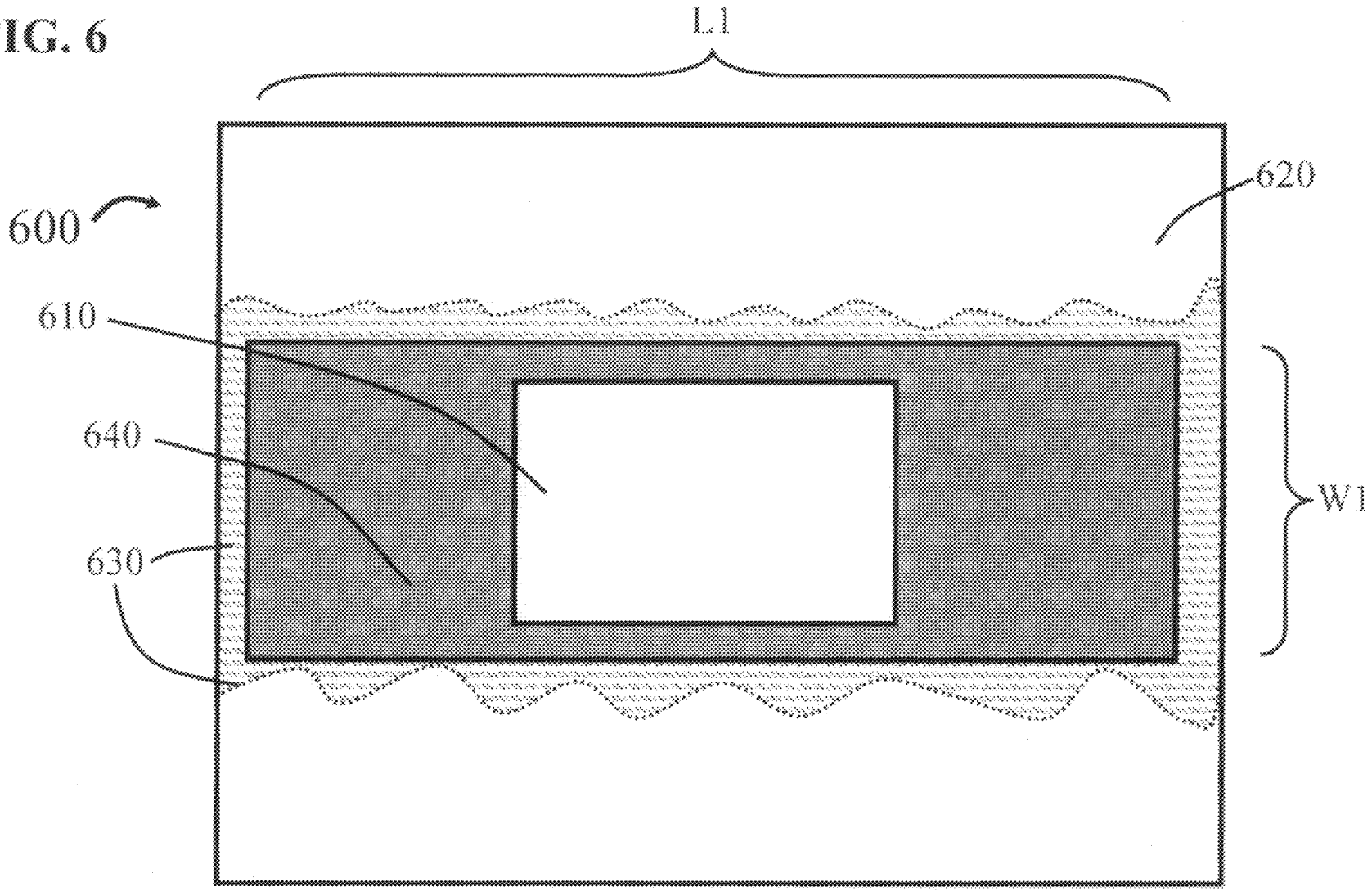
FIG. 6 is a schematic view of another exemplary display panel of an LCD device fluorescent lamp FL backlight device using a bordering technique according to the invention.

FIG. 6 is a schematic view of another exemplary display panel of an LCD device having a fluorescent lamp FL backlight device using a bordering technique according to the present invention. In FIG. 6, a display panel 600 includes an active image display region 610, a non-image display region 620 that surrounds the active image display region 610, and a border area 640 disposed between the active image display region 610 and the non-image display region 620. Although not specifically shown, a backlight device having a plurality of fluorescent lamps FL elements may be disposed on a backside of the display panel 600 to provide light that passes through the display panel 600 to display images.

In FIG. 6, the border area 640 is shown extending nearly to edge portions of the display panel 600. Here, the border area 640 may have a length L1 slightly less than an overall length of the display panel 600, and a width W1 that may be at least greater than a width of the active image display region 610. Although a halo region 630 may exist along an opposing perimeters of the border area 640 in the display panel 600, a viewer may not be distracted from viewing images produced in the active image display region 610 due to the presence of the border area 640. Illumination intensity within the border area 640 may be selected at a higher level of non-uniformity than may be acceptable within the active image display region 610. Accordingly, the border area 640 creates a transition region between the active image display region 610 and the halo region 630 to diffuse the light transmitted through the display panel 600.

The border area 640 may be produced by modifying the pixel values of the pixel regions disposed adjacent to the active image display region 610. Accordingly, modification of the pixel values may not result in modifying operational characteristics of the backlight unit (not shown). Thus, no additional power is required to operate the backlight unit (not shown).

In FIG. 6, although the border area 640 is shown as having a solid gray-scale rectangular geometry, other geometries and colors may also be implemented. For example, the border area 640 may include different textures, concentric frames, and other colors. Moreover, the border area 640 may be manually altered by a user or alterations may be synchronized with the images displayed in the active image display region 610. Furthermore, the border area 640 may partially counteract any non-uniform illumination within the border area 640 itself. For example, the border area 640 may have increased dark pixel values in areas where the illumination is higher.

According to the present invention, the halo effect may be reduced by using a method of backlight tapering that allows elements of a backlight device to be controlled to generate a backlight transition region. Accordingly, perimeter elements of a backlight device may be controlled to partially illuminate a display panel of an LCD device. The perimeter elements may be disposed at locations corresponding to where the active image display region adjoins the non-image display region in the display panel. Thus, by tapering the illumination intensity of the perimeter elements of the backlight device, the halo effect may be diffused and less distinguishable to a viewer, thereby rendering a high contrast region between the active image display region and the non-image display region.

According to the present invention, the tapering method of reducing the halo effect also has the benefit of reducing power consumption of the backlight device by not producing the full illumination intensity at the perimeter elements. That is, the perimeter elements of the backlight device may be operated at less than full power to produce a partial illumination along perimeter areas of the active image display region. Here, the tapering method may be used over single transitional elements of the backlight device, as well as over multiple elements to achieve the greatest diffusion.

Figure 7:
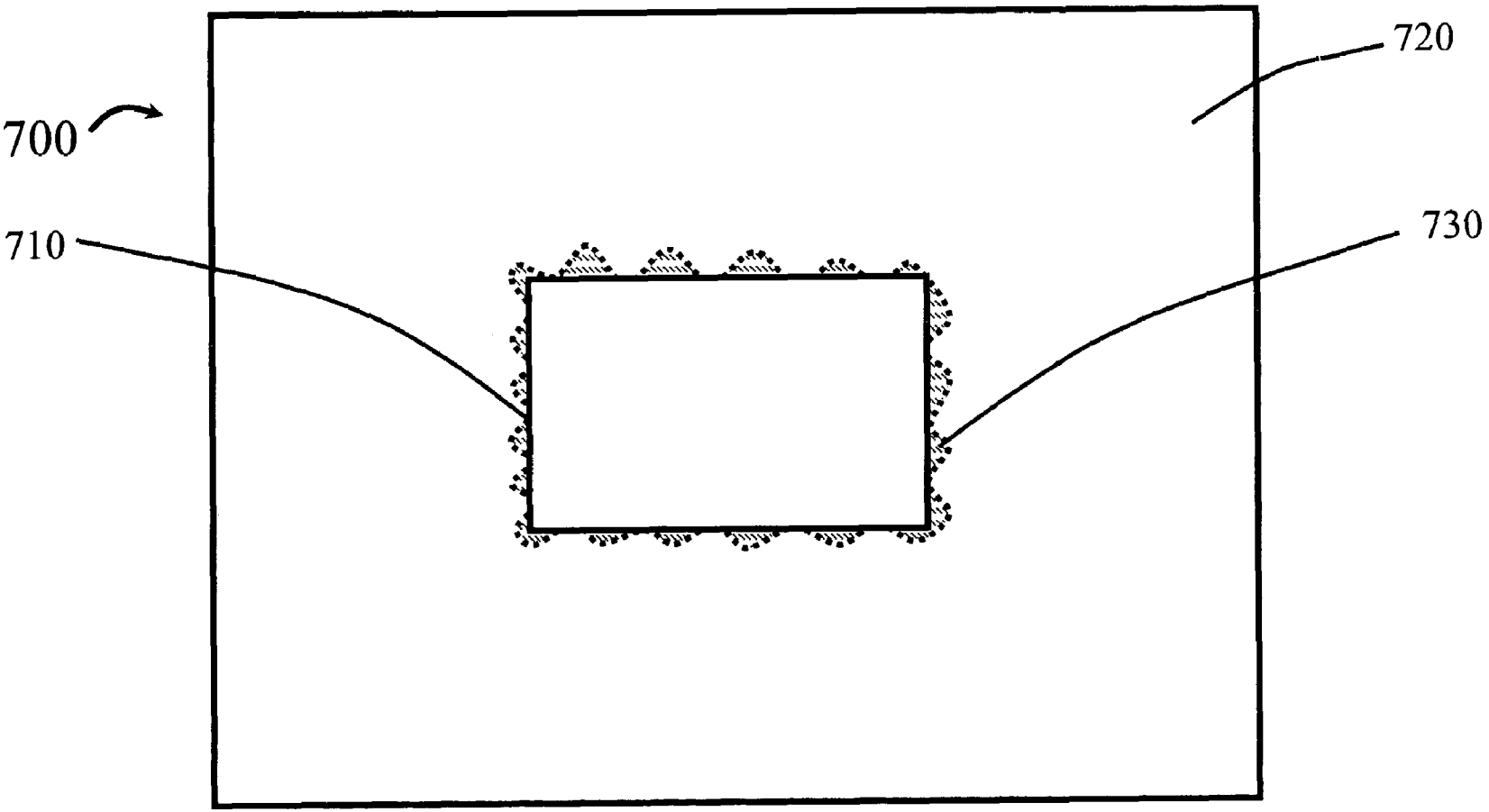
FIG. 7 is a schematic view of another exemplary display panel of an LCD device n LED backlight device using a tapering technique according to the present invention.
Figure 8:
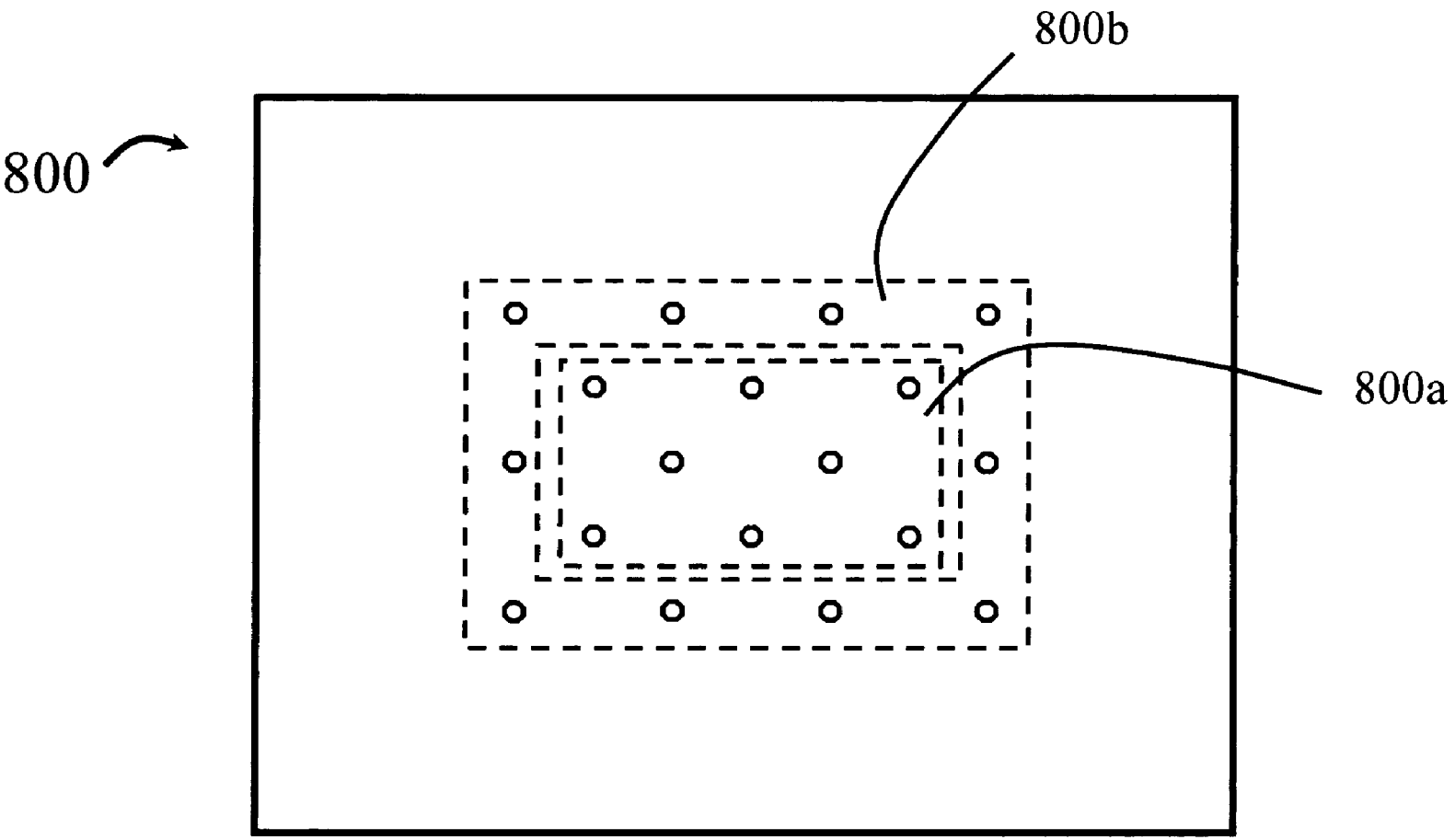
FIG. 8 is a schematic plan view of an exemplary backlight device for the display panel 7 according to the present invention.

FIG. 7 is a schematic view of another exemplary display panel of an LCD device having an LED backlight device using a tapering technique according to the present invention, and FIG. 8 is a schematic plan view of an exemplary backlight device for the display panel of FIG. 7 according to the present invention. In FIG. 7, a display panel 700 may include an active image display region 710, a surrounding non-image display region 720, and a halo region 730 disposed between the active image display region 720 and the non-image display region 720. In FIG. 8, a backlight device 800 may include a first plurality of LED elements 800*a* (delineated by a first dashed line boundary) and a second plurality of LED elements 800*b* (delineated by a second dashed line boundary) laterally encircled by the first plurality of LED elements 800*a*. The first plurality of LED elements 800*a* may be similar to the second plurality of LED elements 800*b*. However, the second plurality of elements 800*b* may be operated at a lower input power to produce an amount of light having a relatively lower illumination intensity than the first plurality of elements 800*a*. As a result, the halo region 730 (in FIG. 7) may be significantly reduced over the prior art, thereby reducing the halo effect and reducing power consumption of the backlight device 800. Accordingly, a viewer may not be distracted from viewing images produced in the active image display region 710 due to the reduced illumination intensity along the perimeter of the active image display region 710. The reduced illumination intensity may provide a low frequency variation (i.e., gradual changes of light level) to a viewer's eye by providing for a gradual transition region from the relatively brighter images displayed by within the active image display region 710 to the less brighter regions of the non-image display region 720.

In FIG. 8, although the second plurality of elements 800*b* are shown to include a single row of individual element, the boundary of the second plurality of elements 800*b* may be drawn to include elements of the first plurality of elements 800*a*. Moreover, although two groupings of elements 800*a* and 800*b* are shown, different groupings may also be selected based upon a desired diffusion pattern of the display panel 700 (in FIG. 7). For example, in FIG. 8, the first plurality of elements 800*a* may correspond to a central area of the active image display region 710 and the second plurality of elements 800*b* may correspond to perimeter areas of the active image display region 710. Accordingly, an intensity of the halo region 730 may be adjusted by relative control of the first and second pluralities of elements 800*a* and 800*b*.

However, the second plurality of elements 800*b* may be selected to include elements of the first plurality of elements 800*a* based upon the characteristics of the image displayed in the active image display region 710 (in FIG. 7). Conversely, the first plurality of elements 800*a* may be selected to include elements of the second plurality of elements 800*b* based upon the characteristics of the image displayed in the active image display region 710 (in FIG. 7). In other words, based upon the images being displayed in the active image display region 710, groupings of the first and second pluralities of elements 800*a* and 800*b* may be varied by a viewer either automatically or manually.

Figure 9:
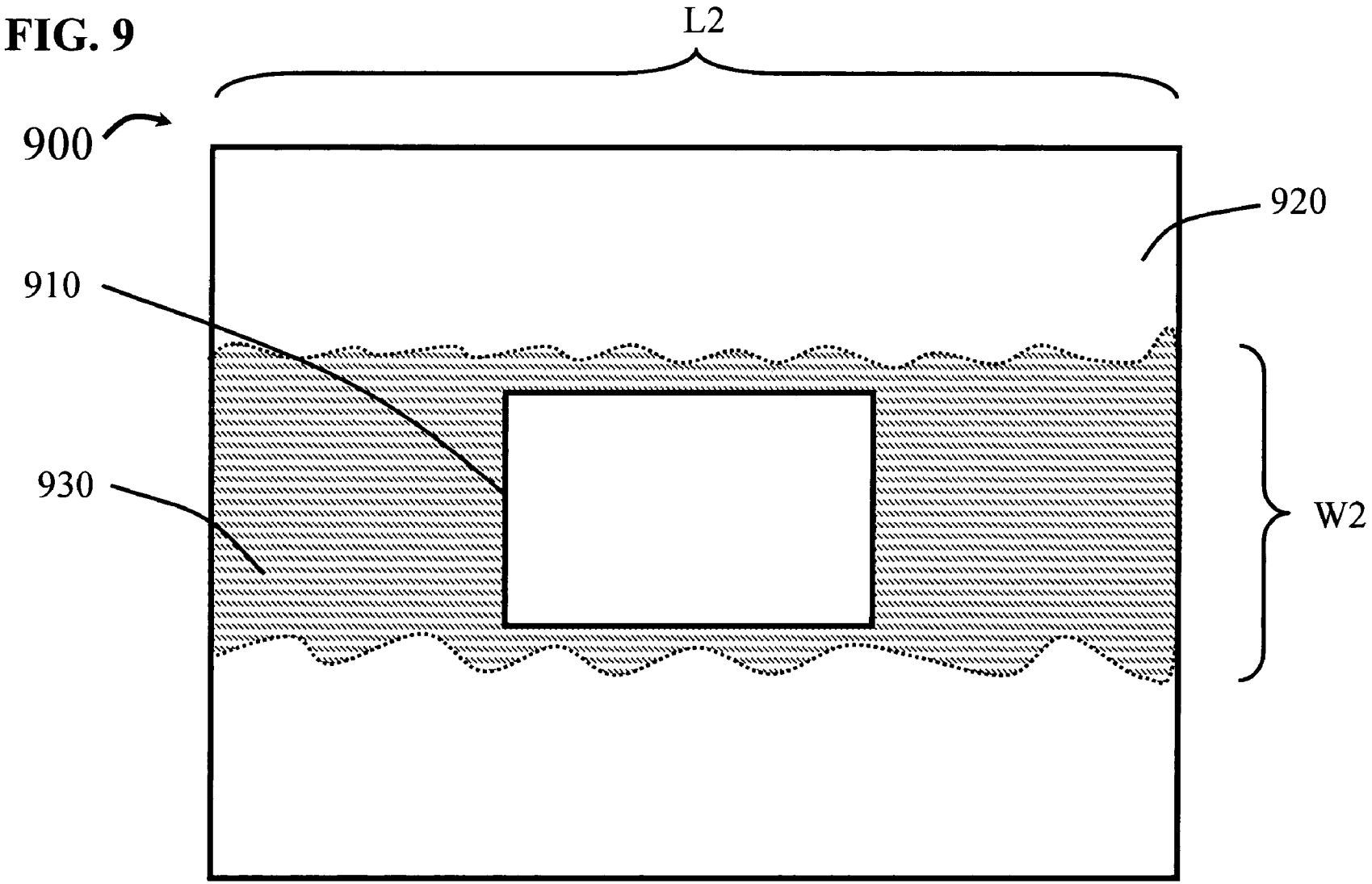
FIG. 9 is a schematic view of another exemplary display panel of an LCD device fluorescent lamp FL backlight device using a tapering technique according to the invention.
Figure 10:
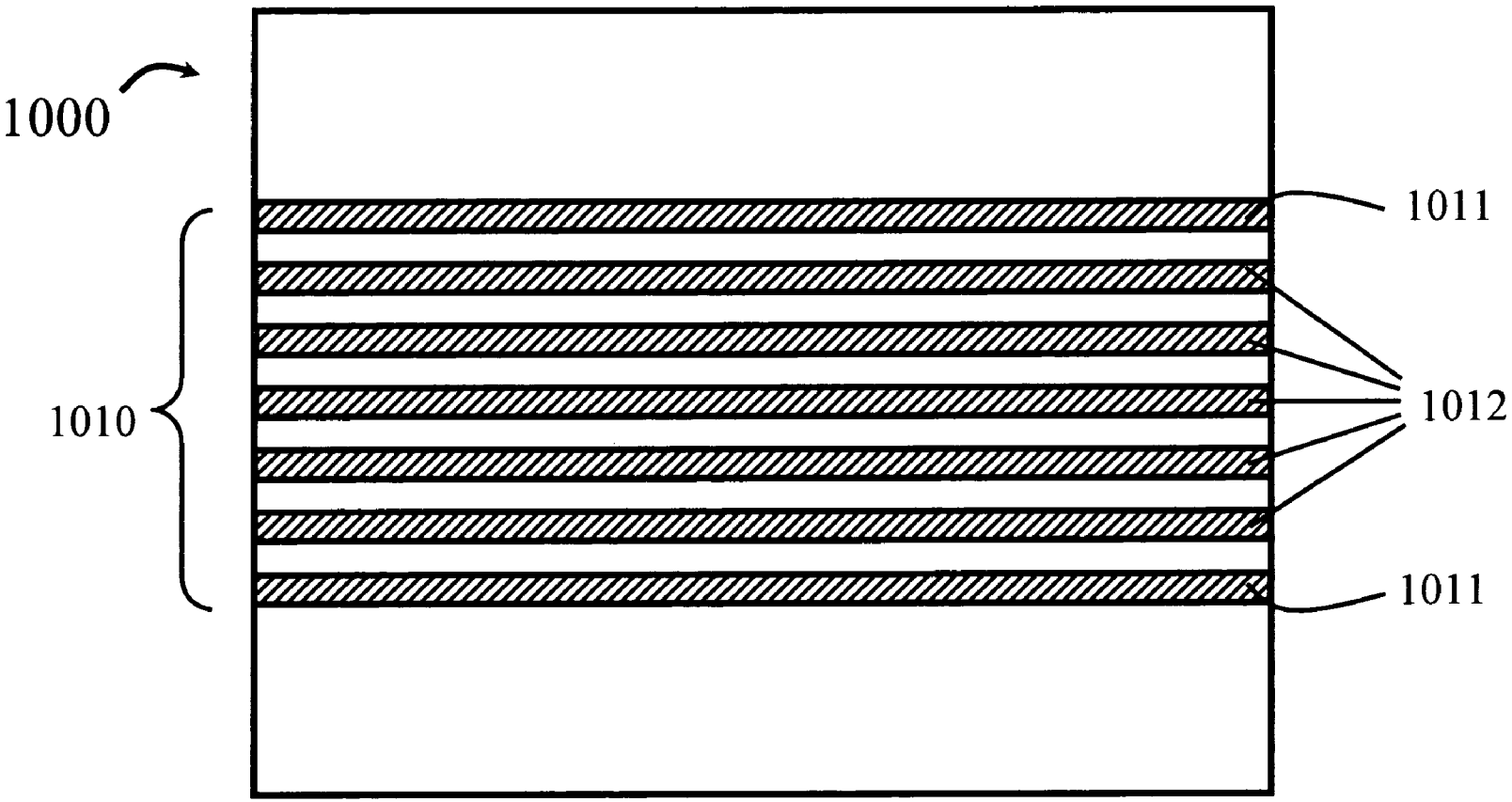
FIG. 10 is a schematic plan view of an exemplary backlight device for the display FIG. 9 according to the present invention.

FIG. 9 is a schematic view of another exemplary display panel of an LCD device having a fluorescent lamp FL backlight device using a tapering technique according to the present invention, and FIG. 10 is a schematic plan view of an exemplary backlight device for the display panel of FIG. 9 according to the present invention. In FIG. 9, a display panel 900 may include an active image display region 910, a surrounding non-image display region 920, and a halo region 930 having a width W2 disposed between the active image display region 910 and the non-image display region 920 and extending along an entire length L2 of the display panel 9000. In FIG. 10, a backlight device 1000 may include a plurality of FL elements 1010. However, a first group of outermost FL elements 1011 of the plurality of FL elements 1010 may be operated at a lower input power to produce an amount of light having a relatively lower illumination intensity than a second group of central FL elements 1012 of the plurality of FL elements 1010. As a result, the halo region 930 (in FIG. 9) may be significantly reduced over the prior art, thereby reducing the halo effect and reducing power consumption of the backlight device 1000.

In FIG. 10, although the first group of outermost FL elements 1011 are shown to include only one FL element, additional FL elements of the second group of central FL elements 1012 may be operated at a lower power. Accordingly, an intensity of the halo region 930 (in FIG. 9) may be adjusted by relative control of the first and second groups 1011 and 1012 of the plurality of FL elements 1010.

According to the present invention, the halo effect may be reduced by using a bordering technique to modify the displayed image and a tapering technique to modify illumination intensity of the backlight device. Accordingly, a further exemplary embodiment may include a combination of the present bordering and tapering techniques to further reduce the halo effect and reduce power consumption.

Figure 11:
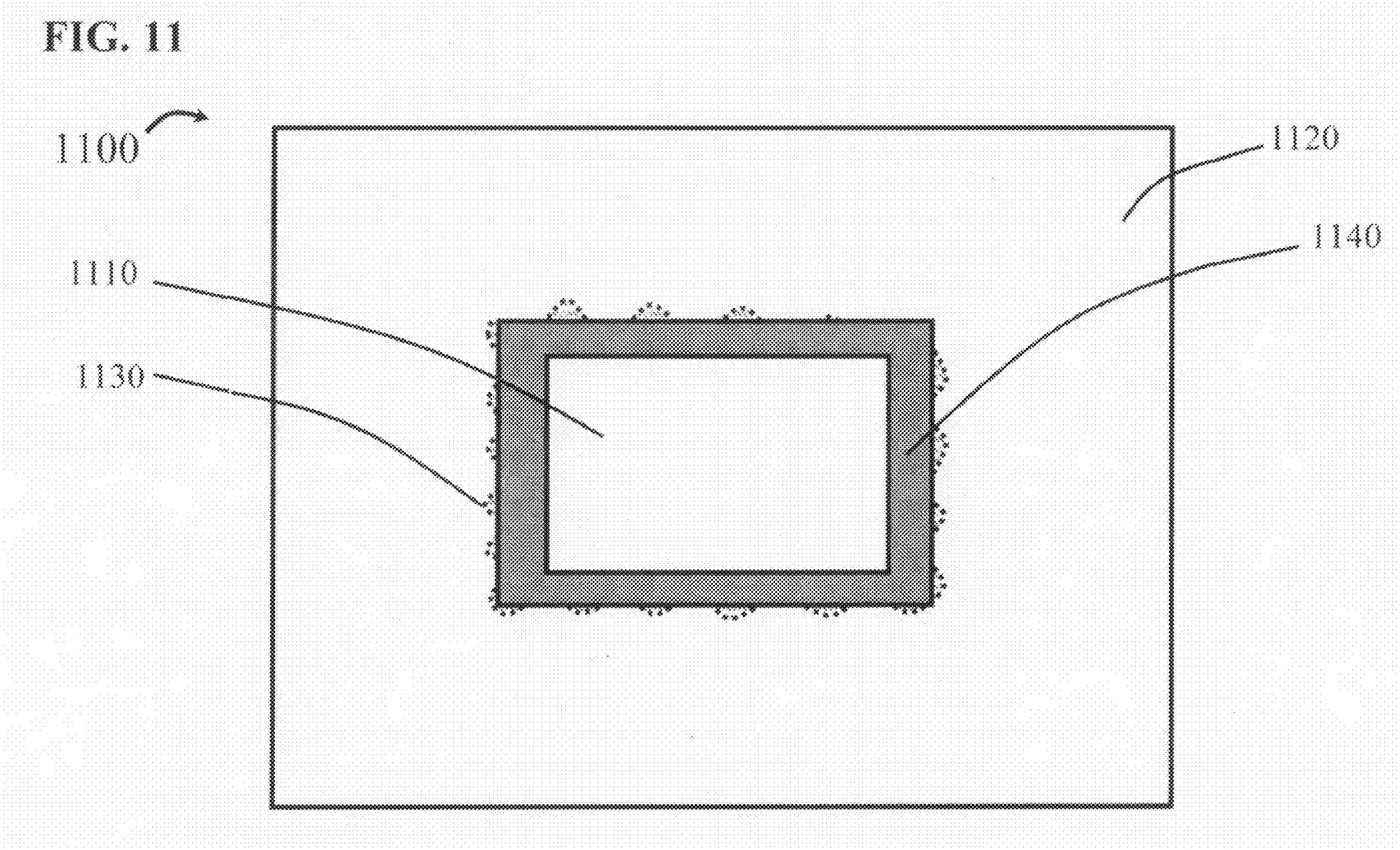
FIG. 11 is a schematic view of another exemplary display panel of an LCD device n LED backlight device using a bordering and tapering technique according to the invention.

FIG. 11 is a schematic view of another exemplary display panel of an LCD device having an LED backlight device using a bordering and tapering technique according to the present invention. The display panel of FIG. 11 may comprise elements of the embodiments shown in FIGS. 5, 7, and 8. Accordingly, discussion of these individual elements may be found above and are not completely reiterated below.

In FIG. 11, a display panel 1100 includes an active image display region 1110, a non-image display region 1120 that surrounds the active image display region 1110, and a border area 1140 disposed between the active image display region 1110 and the non-image display region 1120. Although not specifically shown, a backlight device having a matrix array of LEDs may be disposed on a backside of the display panel 1100 to provide light that passes through the display panel 1100 to display images.

Although a halo region 1130 may exist along an outermost perimeter of the border area 1140 in the display panel 1100, a viewer may not be distracted from viewing images produced in the active image display region 1110. Illumination intensity within the border area 1140 may be selected at a higher level of non-uniformity than may be acceptable within the active image display region 1110. Accordingly, the border area 1140 creates a transition region between the active image display region 1110 and the halo region 1130 to diffuse the light transmitted through the display panel 1100. In addition, a backlight device similar to the backlight device 800 (in FIG. 8) may be implemented with the display panel 1100. Accordingly, the backlight device may include different groupings of LED elements, wherein the different groups may be operated at different input power levels to produce different amounts of light and illumination intensity. As a result, use of the border area 1140 and the tapering of the light emitting elements of a backlight device may reduce the halo region 1130 and reduce power consumption of the backlight and LCD devices. Moreover, with regard to the display panel of FIG. 11, both the bordering and tapering techniques may be modified, as detailed above.

Figure 12:
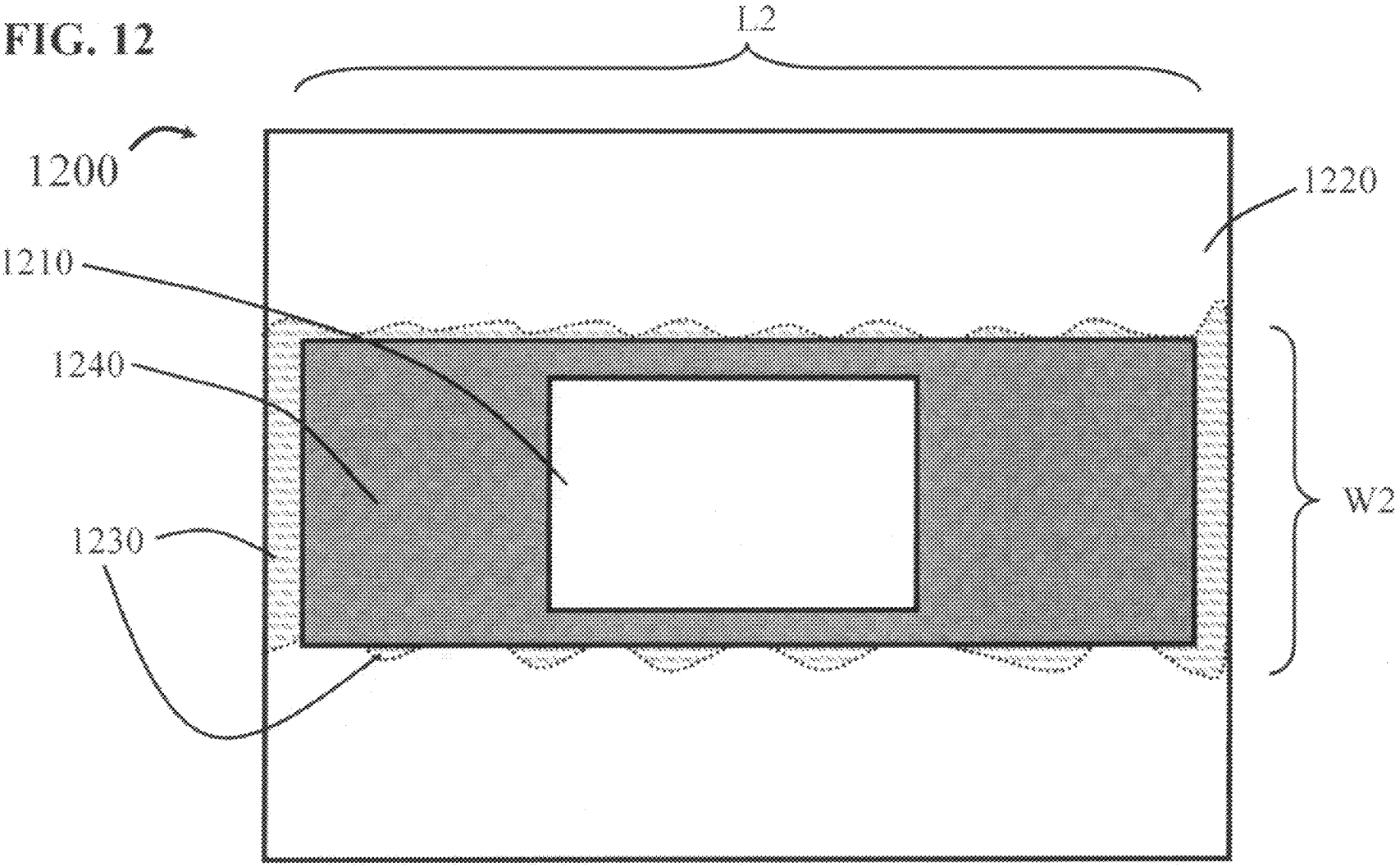
FIG. 12 is a schematic view of another exemplary display panel of an LCD device having a fluorescent lamp FL backlight device using a bordering and tapering technique according to the present invention.

FIG. 12 is a schematic view of another exemplary display panel of an LCD device having a fluorescent lamp FL backlight device using a bordering and tapering technique according to the present invention. The display panel of FIG. 12 may comprise elements of the embodiments shown in FIGS. 6, 9, and 10. Accordingly, discussion of these individual elements may be found above and are not completely reiterated below.

In FIG. 12, a display panel 1200 includes an active image display region 1210, a non-image display region 1220 that surrounds the active image display region 1210, and a border area 1240 disposed between the active image display region 1210 and the non-image display region 1220. Although not specifically shown, a backlight device having a plurality of FL elements may be disposed on a backside of the display panel 1200 to provide light that passes through the display panel 1200 to display images.

Although a halo region 1230 may exist along an outermost perimeter of the border area 1240 along an entire length L2 of the display panel 1200 as well as along a width W2, a viewer may not be distracted from viewing images produced in the active image display region 1210 due to the presence of the border area 1240. Here, the border area 1240 may not extend along the entire length L2. Alternatively, the border area 1240 may extend along the entire length L2. Illumination intensity within the border area 1240 may be selected at a higher level of non-uniformity than may be acceptable within the active image display region 1210. Accordingly, the border area 1240 creates a transition region between the active image display region 1210 and the halo region 1230 to diffuse the light. In addition, a backlight device similar to the backlight device 1000 (in FIG. 10) may be implemented with the display panel 1200. Accordingly, the backlight device may include different groupings of FL elements, wherein the different groups may be operated at different input power levels. As a result, use of the border area 1240 and the tapering of the light producing elements of a backlight device may reduce the halo region 1230 and reduce power consumption of the backlight device. Moreover, with regard to the display panel 1200 of FIG. 12, both the bordering and tapering techniques may be modified, as detailed above.

It will be apparent to those skilled in the art that various modifications and variations can be made in the power generating systems of the present invention without departing from the spirit or scope of the inventions. Thus, it is intended that the present invention covers the modifications and variations of this invention provided they come within the scope of the appended claims and their equivalents.

What is claimed is:

1. A liquid crystal display device, comprising:

a display panel having an active image display region, a non-image display region surrounding the active image display region, and a border area disposed between the active image display region and the non-image display region; and a backlight device adjacent to the display panel and having a plurality of light producing elements corresponding to the active image display region, wherein the border area is disposed between the active image display region and the non-image display region to diffuse light produced by the light producing elements transmitted through the display panel within the border area, and the border area is produced by modifying pixel values of pixels disposed between the active image display region and the non-image display region.

2. The liquid crystal display device according to claim 1, wherein the plurality of light producing elements includes one of light emitting diodes and fluorescent lamps.

3. The liquid crystal display device according to claim 2, wherein the plurality of light emitting diodes include a first group of light emitting diodes disposed within a central area of the active image display region and a second group disposed along a perimeter of the active image display region.

4. The liquid crystal display device according to claim 3, wherein the border area is adjacent to the second group of light emitting diodes to diffuse the light produced by the second group of light emitting diodes transmitted through the display panel within the border area.

5. The liquid crystal display device according to claim 4, wherein the first group of light emitting diodes are operated at a first electrical power input and the second group of light emitting diodes are operated at a second electrical power input lower than the first electrical power input.

6. The liquid crystal display device according to claim 2, wherein the plurality of fluorescent lamps includes a first group of fluorescent lamps disposed within a central area of the active image display region and a second group of fluorescent lamps disposed along opposing perimeters of the active image display region.

7. The liquid crystal display device according to claim 6, wherein the border area is adjacent to the second group of fluorescent lamps to diffuse the light produced by the second group of fluorescent lamps transmitted through the display panel within the border area.

8. The liquid crystal display device according to claim 6, wherein the first group of fluorescent lamps is operated at a first electrical power input and the second group of fluorescent lamps is operated at a second electrical power input lower than the first electrical power input.

9. The liquid crystal display device according to claim 1, wherein the border area is one of a colored image, a solid gray-scale image, patterned texture images, ordered patterned element images, randomly positioned patterned element images, and a plurality of gradiently shaded inner frame images.

10. A liquid crystal display device, comprising:

a display panel having an active image display region and a non-image display region surrounding the active image display region; and a backlight device adjacent to the display panel and having a plurality of light producing elements corresponding to the active image display region, wherein the plurality of light producing elements include a first group of light producing elements producing light and disposed within a central area of the active image display region operating at a first power input level, and a second group of light producing elements producing light and disposed along a perimeter of the active image display region and operating at a second power input level lower than the first power input level.

11. The liquid crystal display device according to claim 10, wherein the plurality of light producing elements includes one of light emitting diodes and fluorescent lamps.

12. The liquid crystal display device according to claim 10, further comprising a border area disposed between the active image display region and the non-image display region to diffuse light produced by the light producing elements transmitted through the display panel within the border area, wherein the border area is produced by modifying pixel values of pixels disposed between the active image display region and the non-image display region.

13. A method of reducing power consumption of a liquid crystal display device, comprising:

providing a first plurality of light producing elements of a backlight device disposed adjacent to a display panel of the liquid crystal display device, each of the first plurality of light producing elements receiving a first input power level and producing a first amount of light, the first plurality of light producing elements disposed adjacent to a central area of an active image display region of the display panel; and providing a second plurality of light producing elements of the backlight device disposed adjacent to the display panel of the liquid crystal display device, each of the second plurality of light producing elements receiving a second input power level less than the first input power level and producing a second amount of light, the second plurality of light producing elements disposed adjacent to a perimeter area of the active image display region of the display panel.

14. The method according to claim 13, wherein the first and second pluralities of light emitting elements include one of light emitting diodes and fluorescent lamps.

15. The method according to claim 13, wherein the first amount of light produced by the first group of light emitting elements is greater than the second amount of light produced by the second group of light emitting elements.

16. The method according to claim 15, further comprising providing a border area between the active image producing region and a non-image producing region that surrounds the active image producing region.

17. The method according to claim 16, wherein the border area diffuses the second amount of light transmitted through the display panel.

18. The method according to claim 17, wherein the border area is one of a colored image, a solid gray-scale image, patterned texture images, ordered patterned element images, randomly positioned patterned element images, and a plurality of gradiently shaded inner frame images.

19. The method according to claim 17, wherein the border area is produced by pixels of the display panel.

20. The method according to claim 17, wherein the non-image display region is darker than the border area.

* * * * *